United States Patent [19]

Hahn

[11] Patent Number: 4,716,668

[45] Date of Patent: Jan. 5, 1988

[54] EXCAVATING TOOTH POINT FOR USE WITH BASKET SPRING RETAINER

[75] Inventor: Frederick C. Hahn, Aloha, Oreg.

[73] Assignee: ESCO Corporation, Portland, Oreg.

[21] Appl. No.: 1,401

[22] Filed: Jan. 8, 1987

Related U.S. Application Data

[63] Continuation-in-part of Ser. No. 791,117, Oct. 24, 1985.

[51] Int. Cl.[4] ..... E02F 9/28

[52] U.S. Cl. ..... 37/142 A; 267/182

[58] Field of Search ..... 37/142 A, 142 R, 141 T, 37/141 R

[56] References Cited

U.S. PATENT DOCUMENTS 3,079,710 3/1963 Larsen et al. ..... 37/142 R
3,106,256 10/1963 McBride ..... 37/142 A X
3,999,614 12/1976 Rhoads ..... 37/142 R X
4,061,432 12/1977 Hahn et al. ..... 37/142 R X
4,136,469 1/1979 Zepf ..... 37/142 R X
4,231,173 11/1980 Davis ..... 37/142 R

*Primary Examiner*—Clifford D. Crowder
*Attorney, Agent, or Firm*—Tilton, Fallon, Lungmus & Chestnut

[57] ABSTRACT

An excavating tooth point having a socket adapted to receive the nose of an adapter, the point being equipped with vertically alinged pin openings and with each pin opening having a recess extending around the pin opening in the socket interior, the recess being defined by a horizontal wall extending from the rear of the point forwardly and merging with a vertical wall so as to provide clearance for a basket spring flange and further including a sloping surface to accommodate the tang of a wear cap.

7 Claims, 9 Drawing Figures

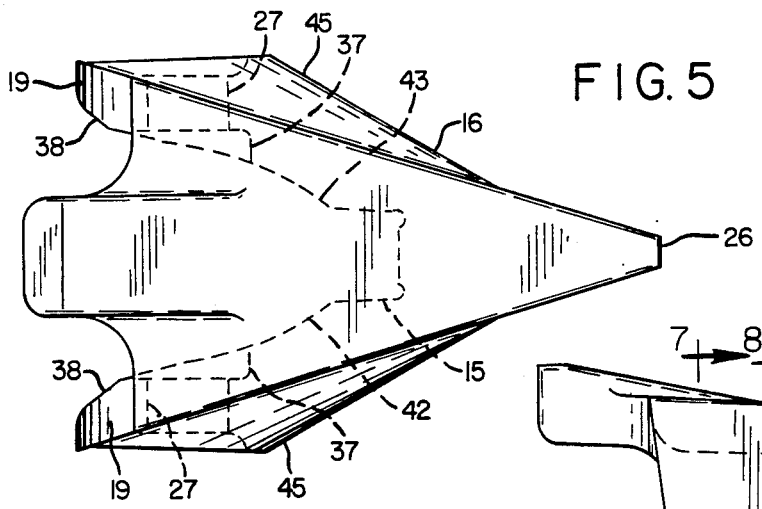
FIG. 5
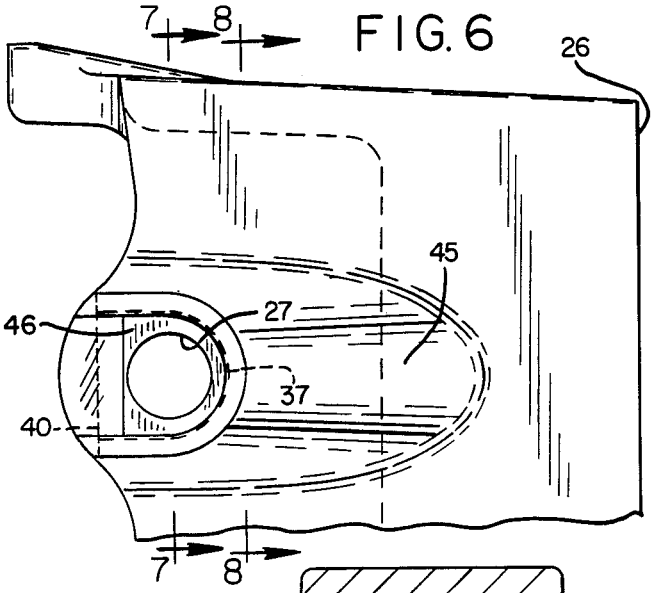
FIG. 6
FIG. 7
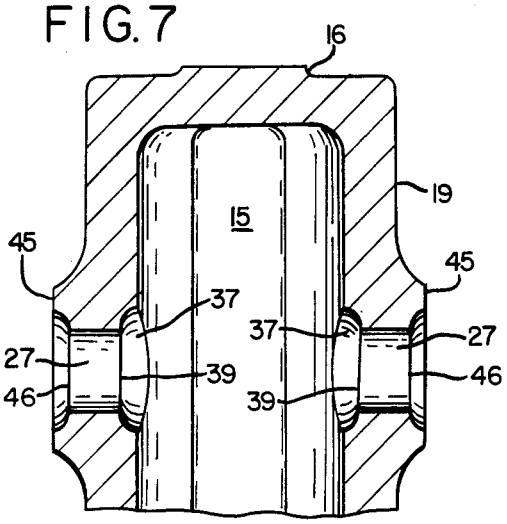
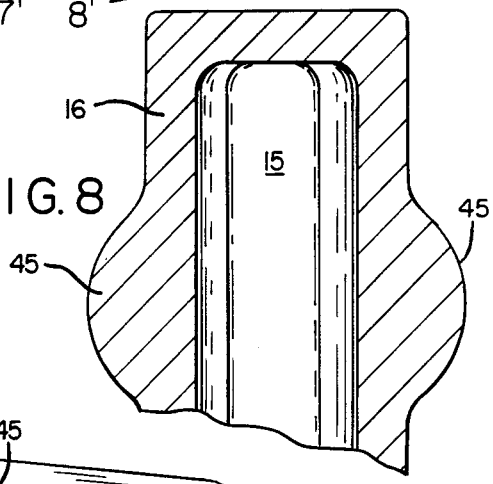
FIG. 8
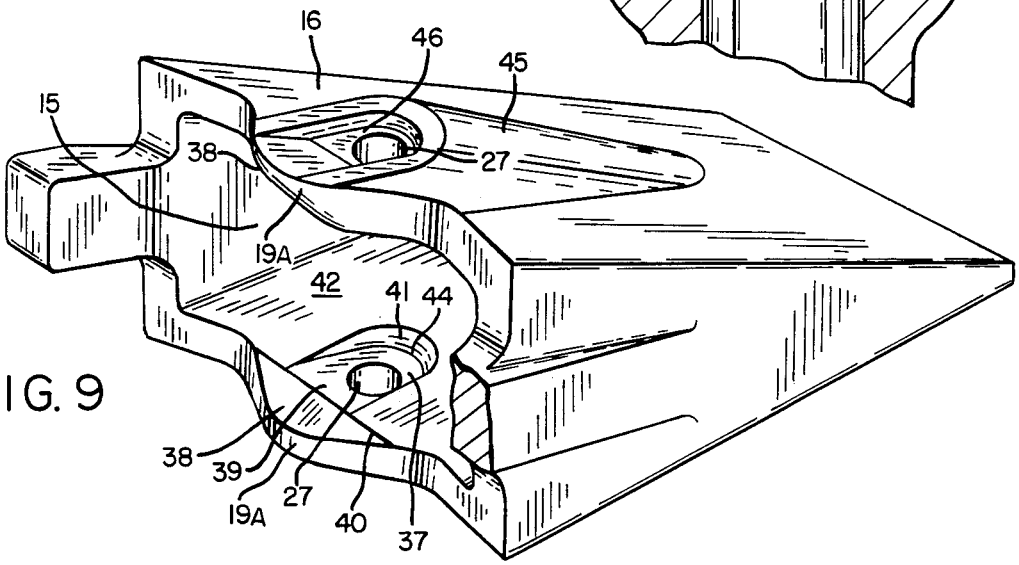
FIG. 9

EXCAVATING TOOTH POINT FOR USE WITH BASKET SPRING RETAINER

This application is a continuation-in-part of my copending application Ser. No. 719,117 filed Oct. 24, 1985.

BACKGROUND AND SUMMARY OF INVENTION

This invention relates to an excavating tooth point and, morh2e particularly, to one which is adapted to be secured to an adapter by a basket spring-equipped pin.

My above identified application describes in detail the basket spring which has a central portion consisting of essentially a double truncated ellipsoid and having end circumferential flanges. To accommodate the use of such a spring along with a tang on a wearcap, novel recesses are provided in the upper and lower convergent socket surfaces of the point.

These recesses are rounded, being radially located from the center line of the pin opening so as to provide 360° clearance around the spring whereby the spring movement is substantially unrestricted. The recesses are defined by a horizontal wall extending from adjacent the rear of the point and merging into a continuous vertical wall so that the point is adapted to be installed or removed without spring interference. This is in studied contrast to the recess-equipped points found in U.S. Pat. Nos. 3,106,256 and 4,061,432.

The invention is described in conjunction with the accompanying drawing, in which FIG. 1 is a sectional view, in fragmentary form, of an excavating or digger tooth constructed according to the teachings of the instant invention;

FIG. 5 is a side elevational view of the tooth point employed in the practice of the invention;

FIG. 6 is a fragmentary top plan view of the point of FIG. 5;

FIG. 7 is a fragmentary sectional view taken along the sight line 7—7 of FIG. 6;

FIG. 8 is a fragmentary sectional view taken along the sight line 8—8 of FIG. 6; and FIG. 9 is a fragmentary perspective view showing the recess of the point interior and a portion of the point exterior.

DETAILED DESCRIPTION

Figures 1, 2, 3, 4:
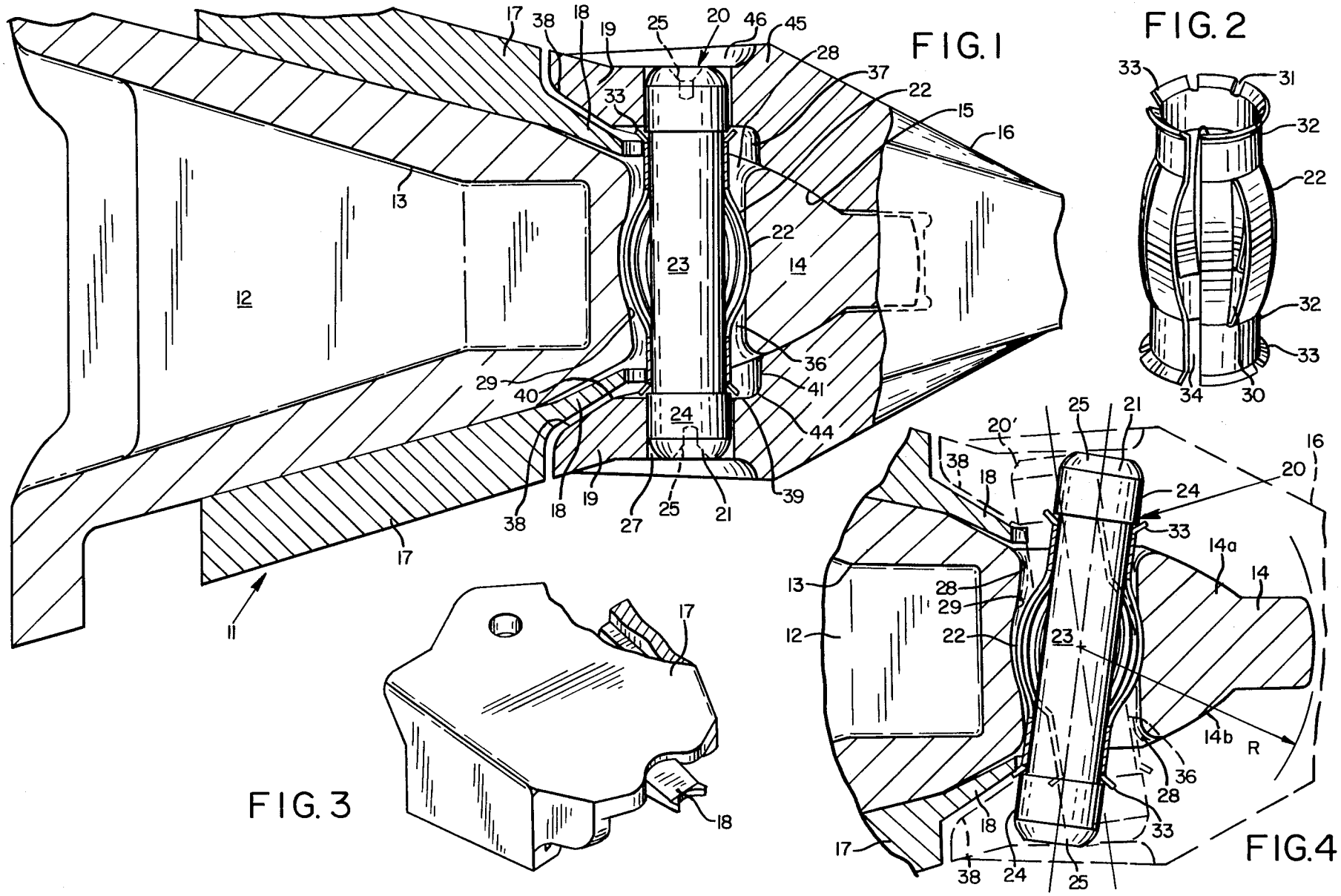
FIG. 2 is a perspective view of the basket spring employed as part of the tooth lock.
FIG. 3 is a perspective view of a wear cap which may be advantageously employed with the inventive locking device, the view being partially broken away to show side rails on the wear cap for mounting on the adapter.
FIG. 4 is a fragmentary sectional view of the adapter nose and associated wear caps showing the type of movement possible through the use of the lock employed in the instant invention.

In the illustration given and with reference first to FIG. 1, the numeral 11 designates generally an excavating tooth which is seen in longitudinal section. The tooth 11 includes an adapter 12 which is normally installed on the forward edge or lip of an excavating machine, viz., dragline bucket, shovel dipper, etc. The adapter has a socket providing portion 13 which fits over the bucket lip and a nose portion 14 which is arranged to be received within the socket 15 (see FIG. 5) of an excavating tooth point 16.

In the illustration given, the adapter is equipped with upper and lower wear caps as at 17, which serve to protect the upper and lower surfaces of the adapter against wear or abrasion from passage of excavated material therepast. The wear caps 17 are identical and thus are interchangeable. The wear cap 17 is equipped with a forwardly-extending tang as at 18 which fits under a shoulder portion 19A of the upper and lower rearwardly-extending walls 19 of the point 16. Thus the point 16, in the first instance, serves to retain the wear caps in place on the adapter 12.

The numeral 20 designates generally the locking mechanism which removably secures the point 16 on the adapter 12—more particularly, the adapter nose 14. The lock mechanism 20 includes a vertically-extending pin 21 and a basket spring 22—the latter seen in perspective view in FIG. 2.

First focusing on the pin 21, it will be seen that this is a unitary element of rather elongated nature and has a reduced diameter central portion 23. This results in larger end portions as at 24—still referring to FIG. 1. Provided at each end of the pin 21 are countersunk openings 25 so that a pointed removal tool or drift pin can be used for easy removal and installation. Through the use of the countersunk openings or holes 25, it is ensured that every pound of removal energy is directed into pure thrust down the axis of the pin, thus eliminating any waste forces, and at the same time providing the solid indentation to receive the removal tool, thus providing a safety advantage.

As one example of the practice of the invention, and in connection with a typical tooth point 16 which weighs approximately 43 pounds and which has a horizontal dimension across the tip 26 (see FIGS. 5 and 6) of approximately 8 inches, the pin 21 has a length of 5.32 inches with the length of the reduced diameter central portion being 3.54 inches. The diameter of the end portions 24 is 1.12 inches and that of the reduced central portion 23, 1.00 inches.

The pin 21 extends through upper and lower openings 27 (see FIGS. 5 and 6) in the upper and lower walls 19 of the point 16. It will be appreciated from a consideration of FIG. 5 that the point 16 is reversible—either side can be positioned upwardly or downwardly as wear patterns develop.

The pin also extends through a vertically-extending opening or passage 28 (see FIG. 1) in the adapter nose 14. The passage 28 can also be seen in the adapter 12 as depicted in FIG. 8.

The passage 28 is contoured as at 29 (see the left hand portion of FIG. 1) so as to receive the basket spring 22. In other words, the passage 28 is radially enlarged so as to conform to the shape of the ellipsoidal shape of the basket spring 22. In effect, the spring central portion has the shape of a double-truncated ellipsoid.

Typically, the basket spring 22 in the example given above relative to an approximately 8-inch wide point is developed from a blank having a height of 3.81 inches and a width of 3.23 inches. The slots 30 (see FIG. 2) have a length of 2.08 inches and a width of 0.06 inches, being spaced apart on 0.48 inch centers. The notches 31 at the top and bottom are not aligned with the slots and have the same width but with a depth of 0.20 inches.

The blank is deformed to the configuration seen in FIG. 2, at which time the height is 3.64 inches. The bowing or bulging—to the ellipsoidal shape—is achieved all within the length of the slots 30 as can be appreciated from a consideration of FIG. 2. This then results in cylindrical collars top and bottom, as at 32, which have a height of 0.67 inches, i.e., the distance between the tops, for example, of the slots 30 and the bottoms of the upper notches 31. The portion of the blank occupied by the notches 31 is flared outwardly at an angle of about 45° to provide end flanges as at 33. Both when relaxed as in FIG. 2 and when installed as in FIG. 1, the basket spring 22 has a circumference slightly less than that provided within the passageway 28 so that a longitudinally-extending gap 34 exists in the circumference of the basket spring 22.

In operation, the tooth 11 is equipped with a single vertical pin rather than two sidelocked pins as in U.S. Pat. Nos. 4,326,348 and 4,428,131. The pin 21 is secured by the basket spring 22 which works like a ball joint to take the shear loads (which normally cause failure of vertical pins) off the pin, retain the pin from premature ejection, and act as a backup lock to prevent loss of the wear caps in the event the point 16 falls off. It will be appreciated that under sharp impact loads, a point 16 may be shattered or fragmented, at which time there would normally be nothing to prevent loss of wear caps. These are not insignificant items, since, in the example given of an 8 inch approximately 43 pound point each wear cap weighs approximately 28 pounds. Also, for the same size point as given in the example, the adapter weighs about 78 pounds.

Turning now to FIG. 4, the ball joint action of the locking mechanism 20 is illustrated. For ease of understanding and clarity of presentation, the point 16 has been omitted from the adapter nose 14. However, the point, being the penetrating implement, receives the beam loads and tends to move in a vertical arc, the direction of which is determined by the direction of the beam loads, such as upwardly or downwardly. This causes the locking mechanism 20 to move accordingly. For example, in FIG. 4, the solid line showing is a condition the locking mechanism could assume upon a heavy downward beam load, whereas the dotted line showing as at 20' would be the position of the locking mechanism upon an upward beam load being applied to the excavating tooth point.

More particularly, the point moves as a result of ball joint action vertically about the butt fit forward area of the nose 14, which advantageously is radiused from the axial center of the passageway 28, viz., the intersection of the nose center line with the axis of passageway 28. Also, the point moves in a rolling fashion about the radiused surfaces on the nose sloping upper and lower faces, as at **14*a* and 14*b* which are generated from centers on the axis of passageway 28**.

To accommodate this rolling or ball joint action, I have enlarged the upper and lower portions of the passage 28 as at 36—see the lower central portion of FIG. 1. Also, I have enlarged the socket 15 of the tooth point 16 as at 37 to accommodate this action and, more particularly, the flanges 33 of the basket spring 22. This extra relief is provided in the upper and lower walls 19 in the portion defining the socket 15 and on the forward side of the passage 17—see particularly FIGS. 6 and 7. Thus, I have specially adapted the interior of the point 16 to accommodate the advantageous ball joint action illustrated in FIG. 4. It will be appreciated that the recesses 37 do accommodate the flanges 33 but it is to be understood that the flanges not only seat or project into the recesses 37 but more particularly move with the pin and point in a unitary assembly during the above-mentioned ball joint action.

The interior or socket portion of the point 16 is also arranged so as to confine the tangs 18 of the wear caps 17. This can be appreciated from the sloping surfaces 38 provided on the inside of the upper and lower walls 19 of the point 16. Referring specifically to FIG. 9, each surface 38 is seen to be, in effect, an extension of its associated recess 37. More particularly, each surface 38 is a ramp leading toward its associated recess 37 to accommodate the projection of the tang 18 of the wear cap 17. Each tang 18, in turn, is arcuate in the portion facing the collar portion 32 of the basket spring 22—as can be seen in FIG. 1—where the tang 18 is seen to be projecting into the recess 37.

Each ramp 38 is provided in the shoulder portion 19A of the upper and lower rearwardly extending walls and is included at an angle of from about 25°-50° depending upon the dimensions of the tang 18.

Through this arrangement and, more particularly, the basket spring, there is at least a temporary assurance that the wear caps will not fall off after the loss of the point and also on occasion, the pin—but the wear caps will normally operate long enough for the operator or maintenance people to notice the point loss and replace it before the wear caps fall off. This might be involved at shift change or during maintenance, so four to eight hours would be possible.

To the best of my knowledge, a basket type spring has never been created for any application, much less for one in the excavating art. Its application provides a much easier and safer installation and removal system over the conventional, which uses the "knuckle-busting" side lock pins.

In operation, the preferred embodiment of the basket spring 2 involves flared ends and a swollen, radiused center. The former acts to keep the spring from going into the pin hole in the point 16 and to retain the wear caps when the point breaks off, and the latter—the radiused central portion—provides the ball joint action and spring take-up to hold the point on the adapter nose. The vertical locking pin 21 has a recessed portion intermediate its length to accept the spring, thus providing stops at each end and under the bearing area in the point so that the pin is retained within the basket spring.

I have found that the construction of the recess is important in achieving the advantageous operation of the ball and socket action developed by the basket spring 22. The recess 37 can be best appreciated from a consideration of FIG. 9 where it is seen to be first defined by a horizontal wall 39 which extends from the rear 40 of the point 16. This horizontal wall 39 extends 360° around the pin opening 27 and merges into a vertical wall 41 which intersects the lower surface 42 of the socket 15. More particularly, the socket 15 is defined top and bottom by convergent surfaces 42 and 43 (see FIG. 5). As can be appreciated from a consideration of both FIGS. 1 and 9, the horizontal wall 39 extends both forwardly and rearwardly of the pin opening 27. In other words, the distance from the pin opening 27 to the forward end 44 of the horizontal wall 39 is approximately the same length as that to the rear 40 of the point. Advantageously, the horizontal wall 39 and the vertical wall 41 merge in an arcuate fashion as can be seen at 44 in FIG. 1.

The recess 37 has a radial forward portion in the vertical wall 41 which is advantageously developed on a radius from the center line of the pin hole 27. The recess 37 thus provides 360° clearance around the spring so that the spring is not substantially restricted in the ball and socket action depicted in FIG. 4.

By virtue of extending the horizontal wall 39 rearwardly to a point adjacent the rear 40 of the point 16, an opening is provided so that the point itself can slide on or off of the adapter without interferring with the spring 22.

The upper and lower surfaces of the point 16 are equipped with integral protruberances as at 45 in FIG. 8 which serve as a key guard. Key guards have been used in the past in the form of wedge shaped projections on the forward side of the pin opening to avoid pin ejection by encountering rocks and the like incident to the excavation operation. In this instance, the key guard 45 has been extended substantially to the rear of the point 16 and a well 46 introduced therein so that a hammer can easily seat the pin 21 flush with the bottom of the well 46.

While in the foregoing specification a detailed description of the invention has been set down for the purpose of examination, many variations of the details hereingiven may be made by those skilled in the art without departing from the spirit and scope of the invention.

I claim:

1. An excavating tooth point adapted to be received on an adapter equipped with a vertical cylindrical pin and a flanged basket spring thereabout, said point being equipped with a rearwardly facing socket for receipt of an adapter nose, said socket being defined top and bottom by forwardly convergent surfaces, said point being equipped with vertically aligned cylindrical openings adjacent to but spaced from the rear of said point for the receipt of said pin, said socket being equipped with a recess adjacent each opening in each convergent surface and defined by a horizontal wall extending forwardly from adjacent the rear of said point and extending 360° about its associated opening, said horizontal wall extending forwardly from its associated opening approximately the same distance as said horizontal wall extends rearwardly of said associated opening, said recess being further defined by a vertical wall merging into said horizontal wall and extending forwardly from adjacent the rear of said point on both sides of said associated opening and forwardly around said associated opening whereby said recess provides a 360° clearance for said spring flange and said point can be installed and removed from said adapter without spring interference and whereby said point is adapted to accommodate ball joint action under impact relative to said spring and adapter.

2. The excavating tooth point of claim 1 in which said vertical wall in the portions thereof extending forwardly around said associated opening is arcuate about the center of said associated opening.

3. The excavating tooth point of claim 1 in which said horizontal and vertical walls are merged along an arc.

4. The excavating tooth point of claim 1 in which said point is equipped with upper and lower exterior surfaces, each of said exterior surfaces being equipped with an integral projection providing a key guard extending substantially around each cylindrical opening, said projection being recessed about said pin opening.

5. The excavating tooth point of claim 4 in which said point rear includes shoulder portions aligned with said cylindrical openings, each shoulder portion being adapted to confront a wear cap tang and being equipped with a ramp surface communicating with an associated cylindrical opening.

6. An excavating tooth point adapted to be received on an adapter equipped with a vertical pin and a flanged basket spring thereabout, said point being equipped with a rearwardly facing socket for receipt of an adapter nose and vertically aligned cylindrical openings for the receipt of said pin, said socket forwardly of each of said openings being equipped with a generally arcuate recess to accommodate said spring flanges, each recess communicating with its associated cylindrical opening, said socket being defined by smooth generally arcuate upper and lower walls terminating in a box-shaped apex, the forward wall of said apex being generally arcuate about a center located on a line through said vertically aligned openings whereby said point when installed on an adapter is adapted to rotate in a vertical plane with the spring flanges being received in said recesses, each recess extending forwardly, rearwardly and laterally of each of said openings, each recess being defined by a horizontal wall extending 360° about its associated opening and by a vertical wall arcuately merging into said horizontal wall in the recess portions forwardly and laterally of its associated opening with said vertical wall intersecting its associated socket wall and whereby said point is adapted to accommodate ball joint action under impact relative to said spring and adapter.

7. An excavating tooth point adapted to be received on an adapter equipped with a vertical pin and a flanged basket spring thereabout, said point being equipped with a rearwardly facing socket for receipt of an adapter nose and vertically aligned cylindrical openings for the receipt of said pin, said socket forwardly of each of said openings being equipped with a recess developed on a radius from the center line of said openings to accommodate said spring flanges with each recess communicating with its associated cylindrical opening, said point rearward of each cylindrical opening being equipped with an integral shoulder aligned with each opening, said shoulder being equipped with an interiorly facing sloping surface constituting an extension of said recess.

* * * * *